US010302373B2

(12) United States Patent
Tian

(10) Patent No.: US 10,302,373 B2
(45) Date of Patent: May 28, 2019

(54) HEAT EXCHANGER

(71) Applicant: DENSO International America, Inc., Southfield, MI (US)

(72) Inventor: Yilin Tian, Southfield, MI (US)

(73) Assignee: DENSO International America, Inc, Southfield, MI (US)

( * ) Notice: Subject to any disclaimer, the term of this patent is extended or adjusted under 35 U.S.C. 154(b) by 154 days.

(21) Appl. No.: 15/449,486

(22) Filed: Mar. 3, 2017

(65) Prior Publication Data

US 2018/0252481 A1 Sep. 6, 2018

(51) Int. Cl.

| | |
|---|---|
| ***F28F 9/26*** | (2006.01) |
| ***F28F 9/02*** | (2006.01) |
| ***F28D 1/053*** | (2006.01) |
| ***F28F 1/12*** | (2006.01) |
| ***F28F 21/08*** | (2006.01) |
| *F28D 21/00* | (2006.01) |

(52) U.S. Cl.

CPC ..... *F28F 9/262* (2013.01); *F28D 1/05366* (2013.01); *F28F 1/126* (2013.01); *F28F 9/0226* (2013.01); *F28F 9/0229* (2013.01); *F28F 21/089* (2013.01); *F28D 2021/0094* (2013.01); *F28F 2265/26* (2013.01); *F28F 2275/04* (2013.01)

(58) Field of Classification Search

CPC .. F28F 9/262; F28F 9/001; F28F 9/002; F28F 9/0224; F28F 9/0226; F28F 9/0229; F28F 21/089; F28D 1/05366

See application file for complete search history.

(56) References Cited

U.S. PATENT DOCUMENTS

| | | | | |
|---|---|---|---|---|
| 3,228,461 | A * | 1/1966 | Seekins | F28F 9/0239 165/152 |
| 5,004,045 | A * | 4/1991 | Le Gauyer | B23K 1/0012 165/149 |
| 7,389,810 | B2 | 6/2008 | Harada | |
| 8,800,642 | B2 * | 8/2014 | Ninagawa | F28F 9/0226 165/148 |
| 9,772,144 | B2 * | 9/2017 | Day | F28F 9/0226 |
| 9,810,484 | B2 * | 11/2017 | Gruber | F28F 9/0224 |
| 2005/0102836 | A1 | 5/2005 | Kroetsch et al. | |

(Continued)

FOREIGN PATENT DOCUMENTS

| | | | |
|---|---|---|---|
| JP | 2001-116484 | A | 4/2001 |
| JP | 2006-064194 | A | 3/2006 |

(Continued)

*Primary Examiner* — Jon T. Schermerhorn, Jr.

(57) ABSTRACT

The present disclosure provides a heat exchanger that includes a plurality of tubes and a side plate arranged most outside of the plurality of tubes. The side plate extends in a longitudinal direction of the plurality of tubes. The heat exchanger further includes a core plate, and longitudinal ends of the plurality of tubes are connected to the core plate. Furthermore, the heat exchanger includes a tank connected to the core plate, and a thermal expansion joint integrally formed in the core plate. The thermal expansion joint is located on an end portion of the core plate, and includes a wall part, which an end portion of the side plate in the longitudinal direction is brazed with, and a bent part, which is configured to be deformed to allow the thermal expansion joint to have flexibility between the side plate and the core plate.

7 Claims, 4 Drawing Sheets

(56) References Cited

U.S. PATENT DOCUMENTS

| | | | | |
|---|---|---|---|---|
| 2010/0252244 | A1* | 10/2010 | Ninagawa | B23K 1/0012 165/177 |
| 2013/0146267 | A1* | 6/2013 | Garret | F28D 7/1684 165/175 |
| 2015/0129186 | A1* | 5/2015 | Day | F28F 9/0226 165/173 |

FOREIGN PATENT DOCUMENTS

| | | | |
|---|---|---|---|
| JP | 4604759 | B2 | 1/2011 |
| JP | 2011-185525 | A | 9/2011 |
| JP | 2011-185526 | A | 9/2011 |
| JP | 5706666 | B2 | 4/2015 |
| WO | 2015061447 | A2 | 4/2015 |

* cited by examiner

HEAT EXCHANGER

FIELD

The present disclosure relates to a heat exchanger.

BACKGROUND

This section provides background information related to the present disclosure which is not necessarily prior art.

A heat exchanger has been provided for a vehicle. One of the conventional heat exchanger may have a core part constructed by alternately layering tubes and fins. A core plate may be arranged on an end of the core part in a tube longitudinal direction. The core plate may have a tube connection face, and an end of the tube may be connected to the tube connection face. The core plate further may have a groove portion defined around an outer periphery of the core plate. A tank may be fitted into the groove portion.

Further, a reinforcing side plate may be arranged on each side of the core part in a direction of layering the tubes and the fins. A longitudinal end portion of the side plate may be brazed to an outer wall of the groove portion of the core plate.

SUMMARY

This section provides a general summary of the disclosure, and is not a comprehensive disclosure of its full scope or all of its features.

An aspect of the present disclosure provides a heat exchanger that includes a plurality of tubes layered in a layering direction and a side plate arranged most outside of the plurality of tubes in the layering direction. The side plate extends in a longitudinal direction of the plurality of tubes. The heat exchanger further includes a core plate extending in the layering direction. Longitudinal ends of the plurality of tubes are connected to the core plate. Furthermore, the heat exchanger includes a tank connected to the core plate and a thermal expansion joint integrally formed in the core plate. The thermal expansion joint is located on an end portion of the core plate in the layering direction. Specifically, the thermal expansion joint includes a wall part, which an end portion of the side plate in the longitudinal direction is brazed with, and a bent part, which is configured to be deformed to allow the thermal expansion joint to have flexibility between the side plate and the core plate.

Another aspect of the present disclosure provides a heat exchanger that includes a plurality of tubes layered in a layering direction and a side plate arranged most outside of the plurality of tubes in the layering direction. The side plate extends in a longitudinal direction of the plurality of tubes. The heat exchanger further includes a core plate extending in the layering direction. Longitudinal ends of the plurality of tubes are connected to the core plate. Furthermore, the heat exchanger includes a tank connected to the core plate and a thermal expansion joint integrally formed in the side plate. The thermal expansion joint is located on an end portion of the side plate in the longitudinal direction. Specifically, the thermal expansion joint includes a wall part, which an end portion of the core plate in layering direction is brazed with, and a bent part, which is configured to be deformed to allow the thermal expansion joint to have flexibility between the side plate and the core plate.

Further areas of applicability will become apparent from the description provided herein. The description and specific examples in this summary are intended for purposes of illustration only and are not intended to limit the scope of the present disclosure.

DRAWINGS

The above and other objects, features and advantages of the present invention will become more apparent from the following detailed description made with reference to the accompanying drawings. The drawings described herein are for illustrative purposes only of selected embodiments and not all possible implementations, and are not intended to limit the scope of the present disclosure.

DETAILED DESCRIPTION

Figure 1:
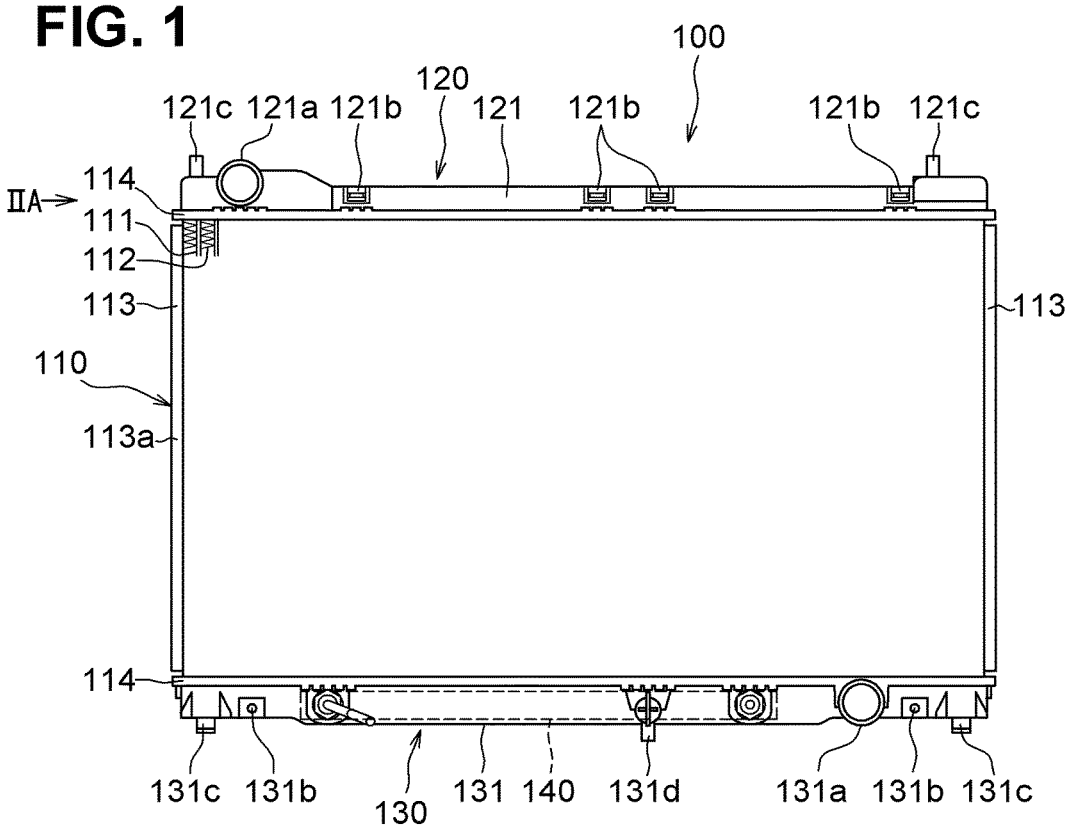
FIG. 1 is a schematic front view illustrating a radiator according to a first embodiment.

A plurality of embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts may be combined. The embodiments may be partially combined even if it is not explicitly described that the embodiments may be combined, provided there is no harm in the combination.

First Embodiment

Figure 2:
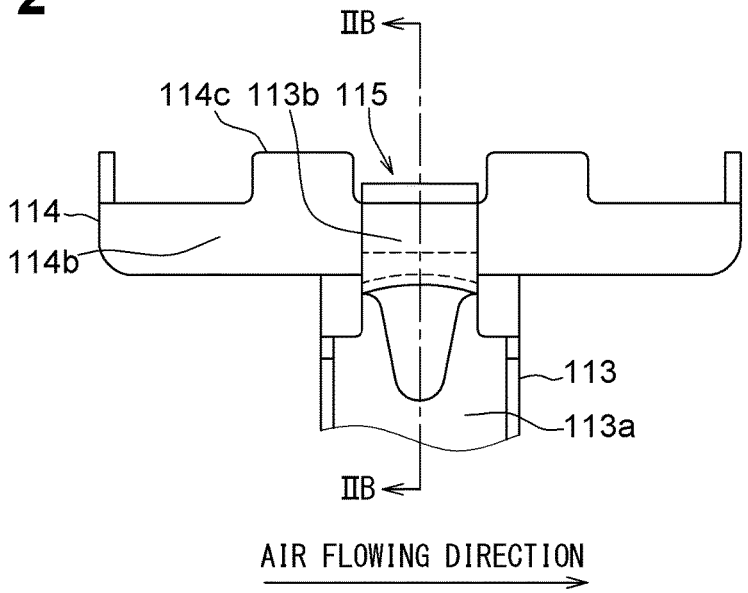
FIG. 2 is a side view illustrating the radiator seen from an arrow direction IIA of FIG. 1.
Figure 3:
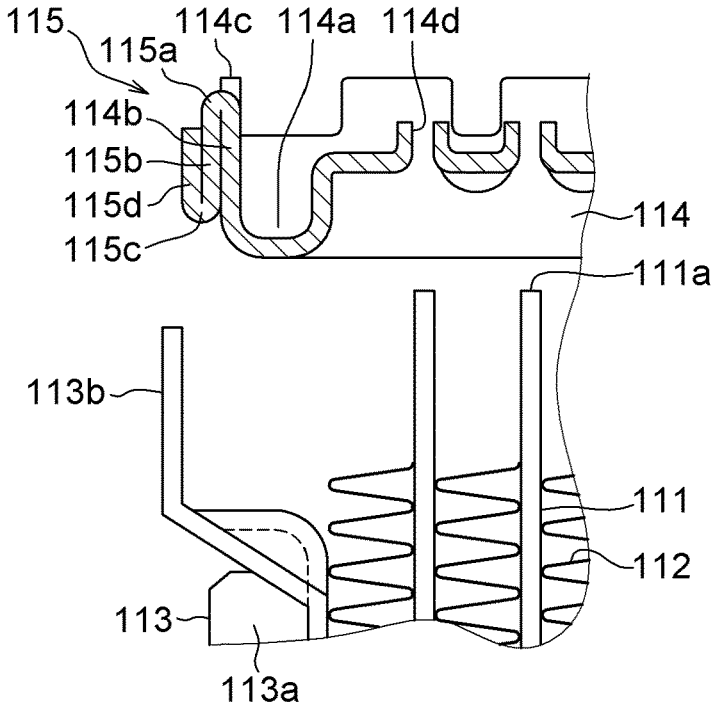
FIG. 3 is an exploded view illustrating tubes, fins, a side plate and a core plate of the radiator according to the first embodiment.
Figure 4:
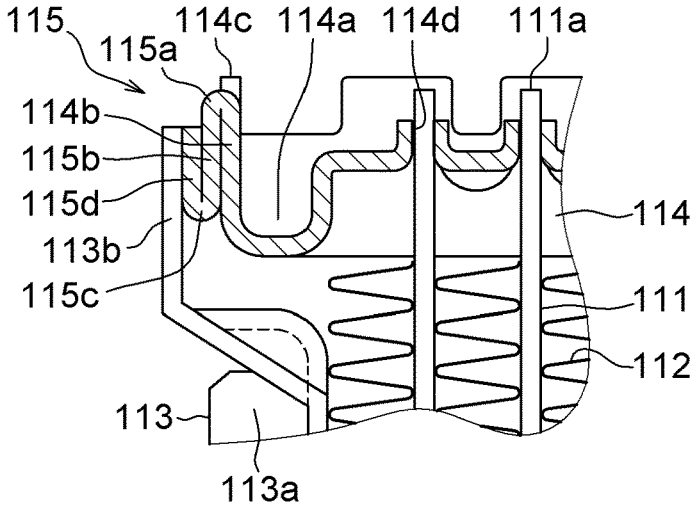
FIG. 4 is a cross-sectional view taken along line IIB-IIB of FIG. 2.

Configuration of a radiator 100 according to the first embodiment will be described. FIG. 1 depicts a schematic front view illustrating the radiator 100 according to the present embodiment. FIG. 2 depicts a side view illustrating the radiator 100 seen from an arrow direction IIA of FIG. 1. FIG. 3 is an exploded view illustrating tubes 111, fins 112, a side plate 113 and a core plate 114 of the radiator 100 according to the present embodiment. FIG. 4 is a cross-sectional view taken along line IIB-IIB of FIG. 2.

In this present embodiment, a heat exchanger is applied to a radiator 100 that cools a vehicle engine (cooling water) using cooled air. As shown in FIG. 1, the radiator 100 has a core part 110, an upper tank 120, and a lower tank 130, for example. The radiator 100 may be a vertical flow type radiator, and cooling water passes through the core part 110 downward in FIG. 1.

The core part 110 has tubes 111, fins 112, a side plate 113, and a core plate 114, which are made of aluminum or aluminum alloy excellent in strength and corrosion resistance.

The tube 111 is a pipe component, and cooling water passes through the tube 111. The tube 111 has a flat cross-section, and is produced by bending a band-shaped member, for example. The fin 112 is a heat emitting component that increases a heat transmission area (heat emitting area). The fin 112 is a corrugated fin having a wave shape, and is produced by a roller process using a thin board member, for example.

The side plate 113 is a reinforcement component, and extends along with the tube 111 with a relatively small width. As shown in FIG. 2, the side plate 113 is constructed by a general part 113*a* and a longitudinal end portion 113*b*. The general part 113*a* is located at middle of the side plate 113 in the longitudinal direction, and has a U-shaped cross-section open outward in the tube layering direction. The end portion 113*b* has a flat shape constructed by only a base of the U-shaped general part 113*a*, and is produced by bending the side plate 113 so as to define a step relative to the general part 113*a* outward in the tube layering direction, as shown in FIG. 3.

The core plate 114 is a narrow board member extending in the tube layering direction. As shown in FIG. 3, a groove portion 114*a* is formed around all outer periphery of the core plate 114 using a pressing machine. The groove portion 114*a* has a first wall 114*b* extending in the tube longitudinal direction, and plural nails 114*c* are defined on an end of the first wall 114*b* in the tube longitudinal direction. The end portion 113*b* of the side plate 113 is connected to the core plate 114 at an end portion of the core plate 114 in the tube layering direction.

As shown in FIG. 2, the end portion of the core plate 114 has plural (two) of the nails 114*c* located at symmetrical positions relative to a center of the core plate 114 in the air flowing direction. An interval between the two nails 114*c* is set larger than the dimension of the end portion 113*b* of the side plate 113 in the air flowing direction.

The core plate 114 further has a thermal expansion joint 115 located between the two nails 114*c* in the air flowing direction. The thermal expansion joint 115 originally protrudes from a tip end of the first wall 114*b* toward the upper tank 120.

The thermal expansion joint 115 has a first bent part 115*a*, a second wall 115*b*, a second bent part 115*c* and a third wall 115*d*. The first bent part 115*a* is defined by bending the tip end of the first wall 114*b*, and is formed in by being bent by 180 degree (U-shaped) from the tip end of the first wall 114*b* toward the core part 110.

The second wall 115*b* further extends from the first bent part 115*a* toward the core part 110. The second bent part 115*c* is defined by bending a tip end of the second wall 115*b*, and is formed by being bent by 180 degree (U-shaped) from the second wall 115*b* toward the upper tank 120. The third wall 115*d* further extends from the second bent part 115*c* toward the upper tank 120. That is, the thermal expansion joint 115 are S-shaped.

As shown in FIG. 3, plural tube holes 114*d* are defined in the core plate 114 in an area inside of the groove portion 114*a*, and positions and shapes of the holes 114*d* correspond to positions and shapes of the layered tubes 111, respectively.

The tubes 111 and the fins 112 are alternately layered with each other in the layering direction corresponding to a left-and-right direction of FIG. 1. A bent part of the wave-shaped fin 112 is contact with an outer wall face of the tube 111. The side plate 113 is located most outside in the tube layering direction and contacts one of the plurality of fins 112 on an opposite side from the plurality of the tubes 111.

As shown in FIG. 4, an end 111*a* of the tube 111 is inserted into the tube hole 114*d* of the core plate 114. The end portion 113*b* of the side plate 113 is contacts an outer wall face of the third wall 115*d*.

The tubes 111, the fins 112, the side plate 113, and the core plate 114 are integrally brazed with each other so as to define the core part 110 after a brazing material is applied on each surface of the tube 111, the side plate 113, and the core plate 114.

The tank 120, 130 is a narrow semi-container members extending in the longitudinal direction of the core plate 114. The tank 120, 130 is mechanically connected to the core plate 114 by swaging the nails 114*c* through a sealing O-ring 116 arranged in the groove portion 114*a* of the core plate 114. Inside of the tube 111 communicates with an inner space of the tank 120, 130.

The upper tank 120 distributes cooling water from the engine to each tube 111, and is made of resin material such as polyamide (PA). The upper tank 120 has an approximately U-shape cross-section when cut in a direction perpendicular to the longitudinal direction. The upper tank 120 has a main part 121 as the semi-container member, and a face of the main part 121 opposing to the core plate 114 is open. The main part 121 integrally has a pipe 121*a*, plural shroud holders 121*b* (4 positions), and plural vehicle mount parts 121*c* (2 positions). Cooling water flows into the tank 120 through the pipe 121*a*. A blower shroud (not shown) is attached to the shroud holders 121*b*. The radiator 100 is attached to a vehicle chassis (not shown) through the vehicle mount parts 121*c*.

The lower tank 130 gathers cooling water from each tube 111, and is made of resin material such as polyamide (PA). The lower tank 130 has an approximately U-shape cross-section when cut in a direction perpendicular to the longitudinal direction, similar to the upper tank 120. The lower tank 130 has a main part 131 as the semi-container member, and a face of the main part 131 opposing to the core plate 114 is open. The main part 131 integrally has a pipe 131*a*, plural shroud holders 131*b* (2 positions), plural vehicle mount parts 131*c* (2 positions), and a drain port 131*d*. Cooling water flows out of the tank 130 through the pipe 131*a*. The blower shroud is attached to the shroud holders 131*b*. The radiator 100 is attached to the vehicle chassis through the vehicle mount parts 131*c*. The drain port 131*d* is used for discharging cooling water at a maintenance time. An oil cooler 140 is disposed in the lower tank 130, and cools automatic transmission fluid (ATF) for an automatic shift of the vehicle.

For example, the radiator 100 is arranged at a front part in an engine compartment of the vehicle, and is located rear of a grill. The vehicle mount part 121*c*, 131*c* is fixed to a frame of the vehicle. An inlet hose extending from the engine is connected to the pipe part 121*a*. An outlet hose extending from the engine is mounted to the pipe part 13*a*.

Cooling water flows into the upper tank 120 from the engine through the inlet hose and the pipe part 121*a*, and is distributed into the tubes 111. While cooling water flows through each of the tubes 111, cooling water is cooled by exchanging heat with air. At this time, the heat exchange is accelerated by the fin 112. Cooling water is gathered by the lower tank 130, and flows toward the engine through the pipe part 131*a* and the outlet hose.

Figure 5:
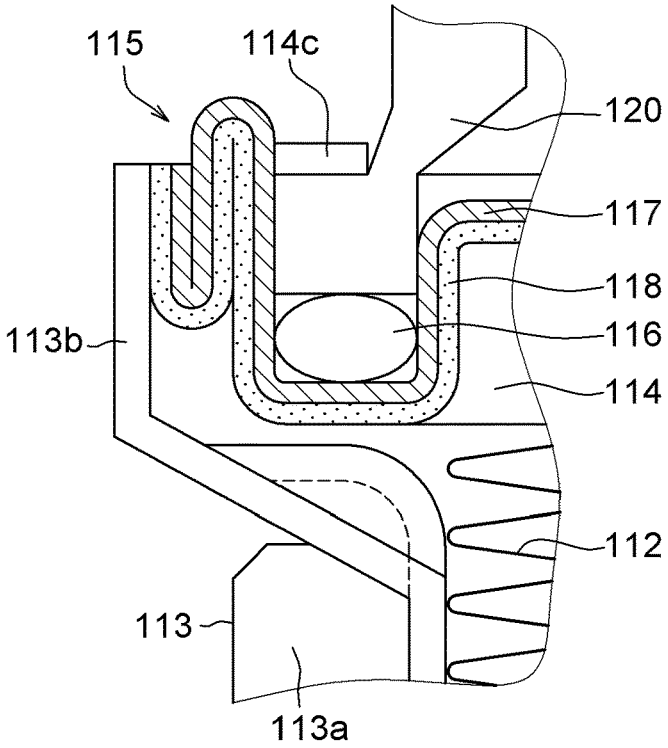
FIG. 5 is a cross-sectional view illustrating the radiator according to the first embodiment.
Figure 6:
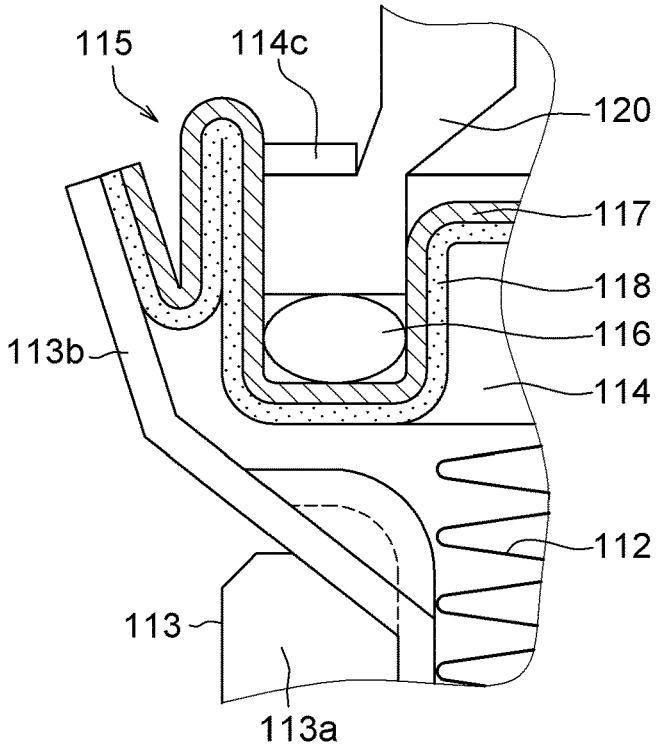
FIG. 6 is a cross-sectional view illustrating the radiator according to the first embodiment.

FIG. 5 depicts a cross-sectional view of a part of the radiator 100 under lower temperature according to the present embodiment. FIG. 6 is a cross-sectional view of a part of the radiator 100 under higher temperature according to the present embodiment.

As shown in FIG. 5, specifically, the core plate 114 includes a core material 117 and a braze layer 118 such that the side plate 113 is brazed with the braze layer 118. The core material is made of aluminum or aluminum alloy. The braze layer is made of braze. The braze layer 118 is stacked or cladded on only one side of the core material 117, and spread on the surface of the core material 117 entirely.

More specifically, the thermal expansion joint 115 has the core material and the braze layer. The first bent part 115*a* is bent inward the braze layer. On the other hand, the second bent part 115*c* is bent outward the braze layer. As a result, the braze layer of the second wall 115*b* contacts the braze layer of the first wall 114*b*. Thereby, the second wall 115*b* is bonded to the first wall 114*b* by brazing. The braze layer of the third wall 115*d* contacts the end portion 113*b* of the side plate 113. Thereby, the side plate 113 is bonded to the third wall 114*b* by brazing. On the other hand, the third wall 115*d* contacts the second wall 115*b* such that the core material of the third wall 115*d* contacts the core material of the second wall 115*b*. Thereby, the second wall 115*b* and the third wall 115*d* are not bonded by brazing with each other to allow the thermal expansion joint 115 to have flexibility between the side plate 113 and the core plate 114.

As shown in FIG. 6, the thermal expansion joint 115 deforms the second bent part 115*c* to open between the second wall 115*b* and the third wall 115*d*. Under higher temperature, the tubes 111 and the side plate 113 expand in accordance with the respective coefficient of thermal expansions. In general, the tubes 111 expand more than the side plate 113. Furthermore, the side plate 113 is much stronger than the tubes 111. Without the thermal expansion joint 115, it may cause high stress on the tubes 111. However, according to the present embodiment, the thermal expansion joint 115 can deform the second bent part 115*c* under force from the side plate 113 and the core plate 114 to reduce the stress on the tubes 111.

It should be noted that the core plate 114 has the respective thermal expansion joints 115 at both ends thereof in the tube layering direction. It should be further noted that both core plates 114 located on an upper tank side and a lower tank side has the respective thermal expansion joints 115.

Second Embodiment

Figure 7:
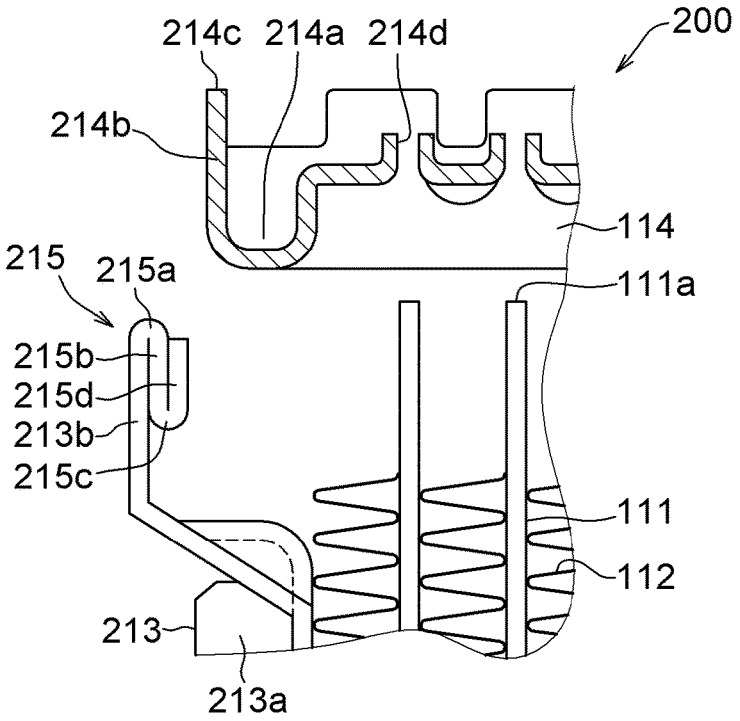
FIG. 7 is an exploded view illustrating tubes, fins, a side plate and a core plate of a radiator according to a second embodiment.

Different aspect of the second embodiment from the first embodiment will be described mainly with reference to FIG. 7. Configuration of a radiator 200 according to the second embodiment will be described. FIG. 7 depicts an exploded view illustrating tubes 111, fins 112, a side plate 213 and a core plate 214 of the radiator 200 according to the present embodiment.

The side plate 213 is a reinforcement component, and extends along with the tube 111 with a relatively small width. The side plate 213 is constructed by a general part 213*a* and a longitudinal end portion 213*b*. The general part 213*a* is located at middle of the side plate 213 in the longitudinal direction, and has a U-shaped cross-section open outward in the tube layering direction. The end portion 213*b* has a flat shape constructed by only a base of the U-shaped general part 113*a*, and is produced by bending the side plate 213 so as to define a step relative to the general part 213*a* outward in the tube layering direction, as shown in FIG. 7.

The core plate 214 is a narrow board member extending in the tube layering direction. As shown in FIG. 7, a groove portion 214*a* is formed around all outer periphery of the core plate 214 using a pressing machine. The groove portion 214*a* has a first wall 214*b* extending in the tube longitudinal direction, and plural nails 214*c* are defined on an end of the first wall 214*b* in the tube longitudinal direction. The end portion 213*b* of the side plate 213 is connected to the core plate 214 at an end portion of the core plate 214 in the tube layering direction. As shown in FIG. 7, plural tube holes 214*d* are defined in the core plate 214 in an area inside of the groove portion 214*a*, and positions and shapes of the holes 214*d* correspond to positions and shapes of the layered tubes 111, respectively.

In the present embodiment, the side plate 213 further has a thermal expansion joint 215. The thermal expansion joint 215 originally protrudes from the end portion 213*b* of the side plate 213 toward the upper tank 120.

The thermal expansion joint 215 has a first bent part 215*a*, a second wall 215*b*, a second bent part 215*c* and a third wall 215*d*. The first bent part 215*a* is defined by bending the tip end of the end portion 213*b* of the side plate 213, and is formed in by being bent by 180 degree (U-shaped) from the tip end of the end portion 213*b* toward the center of the core part 110. The second wall 215*b* further extends from the first bent part 215*a* toward the center of the core part 110. The second bent part 215*c* is defined by bending a tip end of the second wall 215*b*, and is formed by being bent by 180 degree (U-shaped) from the second wall 215*b* toward the upper tank 120. The third wall 215*d* further extends from the second bent part 215*c* toward the upper tank 120. That is, the thermal expansion joint 215 are S-shaped.

Specifically, the side plate 213 includes a core material and a braze layer such that the core plate 214 is brazed with the braze layer of the side plate 213. The core material is made of aluminum or aluminum alloy. The braze layer is made of braze. The braze layer is stacked on only one side of the core material, and spread on the surface of the core material entirely.

More specifically, the thermal expansion joint 115 has the core material and the braze layer. The first bent part 215*a* is bent inward the braze layer. On the other hand, the second bent part 215*c* is bent outward the braze layer. As a result, the braze layer of the second wall 215*b* contacts the braze layer of the end portion 213*b* of the side plate 213. Thereby, the second wall 215*b* is bonded to the end portion 213*b* by brazing. The braze layer of the third wall 215*d* contacts the first wall 214*b* of the core plate 214. Thereby, the core plate 214 is bonded to the third wall 215*d* by brazing. On the other hand, the second wall 215*b* and the third wall 215*d* are not bonded by brazing with each other to allow the thermal expansion joint 215 to have flexibility between the side plate 213 and the core plate 214.

The thermal expansion joint 215 deforms the second bent part 215*c* to open between the second wall 215*b* and the third wall 215*d*. Under higher temperature, the tubes 111 and the side plate 213 expand in accordance with the respective coefficient of thermal expansions. In general, the tubes 111 expand more than the side plate 213. Furthermore, the side plate 213 is much stronger than the tubes 111. Without the thermal expansion joint 215, it may cause high stress on the tubes 111. However, according to the present embodiment, the thermal expansion joint 215 can deform the second bent part 215*c* under force from the side plate 213 and the core plate 214 to reduce the stress on the tubes 111.

Other Embodiments

The radiator 100 to cool the engine is an example of the heat exchanger. However, the heat exchanger is not limited to the radiator 100. Alternatively, the heat exchanger may be an inter cooler to cool intake air of the engine or a condenser for a refrigerating cycle.

In the first embodiment, the core plate 114 includes the core material 117 and the braze layer 118. The core material is made of aluminum or aluminum alloy. However, the core material is not limited to such a structure. The core material may include a strength material, which is made of aluminum or aluminum alloy, and a water liner for corrosion such that the water liner is stacked on only an opposite side of the strength material to the braze material. In such a structure, the second wall may contact the third wall such that the water liner of the core material of the second wall contacts the water liner of the core material of the third wall.

In the first embodiment, the braze layer of the third wall 115*d* contacts the end portion 113*b* of the side plate 113. Thereby, the side plate 113 is bonded to the third wall 114*b* by brazing. However, the thermal expansion joint is not limited to such a structure. The thermal expansion joint may include a braze member between the third wall and the end portion of the side plate. In such a structure, the blaze layer of the third wall may contact and be bonded to the braze member, and the end portion of the side plate may contact and be bonded to the braze member.

In the second embodiment, the braze layer of the third wall 215*d* contacts the first wall 214*b* of the core plate 214. Thereby, the core plate 214 is bonded to the third wall 215*d* by brazing. However, the thermal expansion joint is not limited to such a structure. The thermal expansion joint may include a braze member between the third wall and the first wall of the core plate. In such a structure, the blaze layer of the third wall may contact and be bonded to the braze member, and the first wall of the core plate may contact and be bonded to the braze member.

In the first embodiment, the thermal expansion joint 115 is integrally formed in the core plate 114 at the end portion of the core plate 114 in the tube layering direction. However, the thermal expansion joint is not limited to such a structure. The thermal expansion joint may be separated from the core plate. In such a structure, the thermal expansion joint may be bonded to the core plate.

In the second embodiment, the thermal expansion joint 215 is integrally formed in the side plate 213 at the end portion 213*b* of the side plate 213 in the tube longitudinal direction. However, the thermal expansion joint is not limited to such a structure. The thermal expansion joint may be separated from the side plate. In such a structure, the thermal expansion joint may be bonded to the side plate.

In the first embodiment, the first bent part 115*a* is defined by bending the tip end of the first wall 114*b*, and is formed in by being bent by 180 degree (U-shaped) from the tip end of the first wall 114*b* toward the core part 110. However, the first bent part is not limited to such a structure. The first bent part may be formed in by being bent by less than 180 degree from the tip end of the first wall.

In the second embodiment, the first bent part 215*a* is defined by bending the tip end of the end portion 213*b* of the side plate 213, and is formed in by being bent by 180 degree (U-shaped) from the tip end of the end portion 213*b*. However, the first bent part is not limited to such a structure. The first bent part may be formed in by being bent by less than 180 degree from the tip end of the end portion of the side plate.

In the first embodiment, the second bent part 115*c* is defined by bending a tip end of the second wall 115*b*, and is formed by being bent by 180 degree (U-shaped) from the second wall 115*b* toward the upper tank 120. However, the second bent part is not limited to such a structure. The second bent part may be formed in by being bent by less than 180 degree from the second wall.

In the second embodiment, the second bent part 215*c* is defined by bending a tip end of the second wall 215*b*, and is formed by being bent by 180 degree (U-shaped) from the second wall 215*b*. However, the second bent part is not limited to such a structure. The second bent part may be formed in by being bent by less than 180 degree from the second wall.

In the first embodiment, the braze layer of the second wall 115*b* contacts the braze layer of the first wall 114*b*. Thereby, the first wall 114*b* and the second wall 115*b* are bonded by brazing with each other. However, the second wall is not limited to such a structure. The second wall may not contact the first wall, and may be detached from the first wall. Thereby, the second wall may not be bonded to the first wall by brazing.

In the second embodiment, the braze layer of the second wall 215*b* contacts the braze layer of the end portion 213*b* of the side plate 213. However, the second wall is not limited to such a structure. The second wall may not contact the end portion of the side plate, and may be detached from the end portion of the side plate.

In the first embodiment, the core material of the third wall 115*d* contacts the core material of the second wall 115*b*. However, the third wall is not limited to such a structure. The third wall may not contact the second wall, and may be detached from the second wall.

In the second embodiment, the core material of the third wall 215*d* contacts the core material of the second wall 215*b*. However, the third wall is not limited to such a structure. The third wall may not contact the second wall, and may be detached from the second wall.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat exchanger comprising:

a plurality of tubes layered in a layering direction;

a side plate arranged most outside of the plurality of tubes in the layering direction, the side plate extending in a longitudinal direction of the plurality of tubes, a core plate extending in the layering direction, longitudinal ends of the plurality of tubes being connected to the core plate;

a tank connected to the core plate; and a thermal expansion joint integrally formed in the core plate, the thermal expansion joint being located on an end portion of the core plate in the layering direction, wherein the core plate forms a groove portion around all outer periphery thereof, the groove portion having a first wall extending in the longitudinal direction, the core plate further forms a nail defined on an end of the first wall in the longitudinal direction, the tank is mechanically connected to the core plate by swaging the nail through a sealing member arranged in the groove portion, the thermal expansion joint has a first bent part, a second wall, a second bent part and a third wall, the first bent part being defined by bending the tip end of the first wall, the second wall further extending from the first bent part, the second bent part being defined by bending a tip end of the second wall, the third wall further extending from the second bent part, and the third wall is brazed with an end portion of the side plate in the longitudinal direction, and the second bent part is configured to be deformed to allow the thermal expansion joint to have flexibility between the side plate and the core plate.

2. The heat exchanger according to claim 1, wherein the thermal expansion joint has a core material and a braze layer, the braze layer being cladded on only one side of the core material, the first bent part is formed in by being bent inward the braze layer, the second bent part is formed in by being bent outward the braze layer, and the third wall is brazed with the end portion of the side plate via the braze layer.

3. The heat exchanger according to claim 2, wherein the braze layer of the first wall contacts the braze layer of the second wall such that the first and second walls are brazed with each other, and the core material of the second wall contacts the core material of the third wall such that the second bent part is configured to be deformed.

4. The heat exchanger according to claim 2, wherein the core material includes a strength material and a water liner, the water liner being stacked on only an opposite side of the strength material to the braze material, the braze layer of the first wall contacts the braze layer of the second wall such that the first and second walls are brazed with each other, and the water liner of the core material of the second wall contacts the water liner of the core material of the third wall such that the second bent part is configured to be deformed.

5. The heat exchanger according to claim 1, wherein the thermal expansion joint is formed in S-shaped.

6. The heat exchanger according to claim 1, further comprising:

a plurality of fins formed into being corrugated, wherein the tubes and the fins are alternately layered with each other in the layering direction, and the side plate contacts one of the plurality of fins on an opposite side from the plurality of the tubes.

7. The heat exchanger according to claim 1, wherein the side plate includes a general part and the longitudinal end portion, the general part is located at middle of the side plate in the longitudinal direction, the general part having a U-shaped cross-section open outward in the tube layering direction, and the end portion has a flat shape and is produced by bending the side plate so as to define a step relative to the general part outward in the tube layering direction.

* * * * *